United States Patent [19]

Yokoi et al.

[11] Patent Number: 4,839,960

[45] Date of Patent: Jun. 20, 1989

[54] METHOD OF MANUFACTURING CIRCUIT COMPONENT SUCH AS STATOR FOR VARIABLE RESISTOR

[75] Inventors: Tsutomu Yokoi; Hiroji Tani; Tohru Kasanami; Norio Fukui; Keizou Yamamoto, all of Kyoto, Japan

[73] Assignee: Murata Manufacturing Co.,Ltd., Japan

[21] Appl. No.: 198,326

[22] Filed: May 25, 1988

[30] Foreign Application Priority Data

May 29, 1987 [JP] Japan ..... 62-136087
May 29, 1987 [JP] Japan ..... 62-136088
Oct. 23, 1987 [JP] Japan ..... 62-268749

[51] Int. Cl.[4] ..... H01C 17/06

[52] U.S. Cl. ..... 29/620; 29/25.42; 264/272.15; 264/272.18; 264/105; 264/131; 264/132; 156/344

[58] Field of Search ..... 29/620, 25.42; 264/272.15, 272.17, 272.18, 272.21, 297, 8, 105, 104, 129, 131, 132, 264; 156/344; 425/DIG. 34

[56] References Cited

U.S. PATENT DOCUMENTS 2,606,985 8/1952 DeBell ..... 264/272.18
3,013,913 12/1961 Croop et al. ..... 264/104
3,085,295 4/1963 Pizzino et al. ..... 264/272.17
3,618,200 11/1971 Matsuo et al. ..... 264/272.18
4,350,741 9/1982 Hasegawa et al. ..... 264/272.18

FOREIGN PATENT DOCUMENTS 57-11125 3/1982 Japan .

*Primary Examiner*—P. W. Echols
*Attorney, Agent, or Firm*—Ostrolenk, Faber, Gerb & Soffen

[57] ABSTRACT

A stator for a variable resistor, manufactured by a step of preparing a heat resistant film of polyimide, a step of preparing a transfer sheet by providing a resistor film containing carbon powder and allyle resin, such as diallyl phthalate resin, on the heat resistant film, a step of preparing a lead terminal, a step of preparing a forming die having a cavity for forming a substrate, a step of locating the transfer sheet and the lead terminal in the forming die to expose at least a part of the resistor film in the cavity and position a part of the lead terminal in the cavity, a step of introducing allyle resin, such as diallyl phthalate resin, into the cavity to form a substrate joined with at least a part of the resistor film, in which substrate a part of the lead terminal is buried, and a step of separating the heat resistant film from the substrate to leave the resistor film.

13 Claims, 7 Drawing Sheets

METHOD OF MANUFACTURING CIRCUIT COMPONENT SUCH AS STATOR FOR VARIABLE RESISTOR

BACKGROUND OF THE INVENTION

1. Field of the Invention

The present invention relates to a method of manufacturing a circuit component such as a stator for a variable resistor, which comprises a film electrical element such as a resistor film, a conductor film or the like, for example, provided on the surface of a substrate. More particularly, it relates to a method of forming the film electrical element on the surface of the substrate.

2. Description of the Prior Art

A film electrical element such as a resistor film or a conductor film is provided on the surface of a substrate of resin, for example, most typically by screen printing. Namely, paste prepared for forming a resistor or conductor film is applied onto the surface of a substrate by screen printing, thereby to provide a paste film of a desired pattern, which is then dried and thereafter fired. Thus, obtained is a circuit component which comprises a resistor film and/or a conductor film of desired pattern(s) provided on the surface of a substrate.

In the aforementioned method, however, it has been difficult to provide the film electrical element on a nonplanar surface such as a curved surface, for example. Further, thickness of the film electrical element is directly influenced by the surface state of the substrate. Therefore, if the substrate itself is cambered or its surface is uneven, the film electrical element cannot be provided in uniform thickness on the surface of such a substrate. Thus, it is difficult to regularly stably obtain film electrical elements having desired electrical properties. This leads to dispersion in electrical property between circuit components thus obtained.

A typical example of a circuit component is a stator for a variable resistor, which stator generally comprises an electrical insulating substrate and a resistor film provided in a C-shaped configuration, for example, on its surface. On the other hand, the variable resistor comprises, as rotor structure, a brush which is brought into contact with the resistor film to slide along the longitudinal direction of the resistor film. This brush is driven to rotate so that the angle of its rotation is substantially proportionate to a resistance value provided by the variable resistor, in general. However, it is difficult to attain linear relation between the rotational angle of the brush and the resistance value due to the ununiform thickness of the resistor film resulting from the aforementioned cause. Particularly in a small variable resistor such as a chip-type one, the relation between the rotational angle and the resistance value is significantly influenced by the aforementioned ununiform thickness of the resistor film. Further, a resistor film provided by screen printing tends to have an inverted U-shaped surface in cross section. When a brush slides along the surface having an inverted U-shaped section, a contact point of the brush to the resistor film may deviate in the cross direction of the resistor film with sliding of the brush. This also inhibits linear relation between the rotational angle of the brush and the resistance value. In the small variable resistor such as a chip-type one, further, the resistor film cannot be strongly adhered to the substrate because of its small area, and hence the resistor film may be partially separated from the substrate.

Japanese Patent Publication Gazette No. 11125/1982 suggests means for solving the aforementioned problems of ununiform thickness of the resistor film, inhibition of linear relation between the rotational angle of the brush and the resistance value caused by the ununiform thickness and low adhesion between the resistor film and the substrate. This gazette discloses a method of applying resistive paste on a metal plate having a smooth surface to form a paste film, laminating a plurality of prepreg sheets respectively impregnated with thermosetting resin materials having specific properties and heating the laminate with pressurization for hardening the multilayer of prepreg sheets to provide a substrate and separating the metal plate from the substrate to leave a resistor film obtained from the resistive paste on the substrate.

According to the aforementioned technique, the resistor film can be easily obtained in relatively uniform thickness due to smoothness of the surface of the metal plate, while adhesion of the resistor film to the substrate can be improved since the resistor film is embedded in the substrate to define a surface which is even level with that of the substrate. However, this technique is restricted to a flat substrate, and inadequate to manufacture a substrate having a complicated configuration. For example, it is difficult to manufacture a stator having a relatively complicated configuration such as that for a variable resistor provided with a resistor film and having a function for holding lead terminals, unless further steps are introduced.

Further, electrical properties of a circuit component comprising a film electrical element cannot be checked until the film electrical element is actually provided. This is because the composition of resistive or conductive paste for forming film electrical elements is slightly varied with manufacturing lots while electrical properties of finished film electrical elements are influenced by various conditions such as printing, drying, baking and the like. In actual manufacturing, therefore, a small number of prototypes are first prepared for each lot of the resistive or conductive paste for checking electrical properties of the prototypes, to thereafter start mass production. This process is adapted to prevent total defectiveness of products included in any manufacturing lot which cannot attain target electrical properties. In general, however, two to four hours are required for preparing such prototypes and checking electrical properties thereof, while stopping the production facility. Thus, productivity is reduced every time the lot is changed, leading to increase in production cost.

SUMMARY OF THE INVENTION

Accordingly, an object of the present invention is to make it possible to efficiently check electrical properties of a film electrical element to be provided on a substrate in a preliminary stage of manufacturing a circuit component.

Another object of the present invention is to provide a method of manufacturing a circuit component, which can easily prevent occurrence of defectiveness.

Still another object of the present invention is to provide a method of efficiently manufacturing a circuit component which comprises a film electrical element having desired electrical properties.

A further object of the present invention is to provide a method of manufacturing a circuit component, which method is suitable for producing small quantities of various products.

A further object of the present invention is to provide a method of easily forming a film electrical element on a substrate having a complicated configuration.

A further object of the present invention is to provide a method of easily forming a film electrical element of a desired configuration on a curved surface.

A further object of the present invention is to provide a method of easily forming a film electrical element having uniform thickness.

A further object of the present invention is to provide a method of manufacturing a circuit component having a film electrical element which can be strongly adhered to a substrate.

A further object of the present invention is to provide a method of manufacturing a stator for a variable resistor, which stator comprises a resistor film having a smooth and flat surface.

A further object of the present invention is to provide a stator for a variable resistor, which stator can change its resistance value in correct linear relation to the angle of rotation of a brush.

Provided according to the present invention is a method of manufacturing a circuit component which comprises a substrate of resin and a film electrical element formed on the surface of the substrate. This method comprises:

a step of preparing a heat resistant film;

a step of forming a desired film electrical element on the heat resistant film;

a step of preparing a forming die having a cavity for forming a substrate;

a step of locating the heat resistant film being provided with the film electrical element in the forming die to expose at least a part of the film electrical element in the cavity; and a step of introducing resin into the cavity to form by the resin a substrate which is joined with the said at least a part of the film electrical element.

According to a preferred embodiment of the present invention, further included is a step of separating the heat resistant film from the film electrical element joined with the substrate. Thus, the heat resistant film is employed as a carrier for transferring the film electrical element to the substrate. The step of thus transferring the film electrical element is advantageously applied to manufacturing of a stator for a variable resistor. Namely, a resistor film to be provided on the surface of a substrate is first provided on a heat resistant film, which is separated from the resistor film after the resistor film is joined with a substrate.

According to the present invention, electrical properties of the film electrical element such as a resistor film can be checked in a stage provided on a heat resistant film. Further, the film electrical element can be provided on a substrate while maintaining the electrical properties thus checked. Thus, if the film electrical element has desired electrical properties in a stage provided on the heat resistant film, mass production can be immediately started. If the film electrical element provided on the heat resistant film has improper electrical properties to the contrary, subsequent steps can be stopped in this stage to prevent occurrence of defectiveness.

Further, various types of film electrical elements can be stored in states being provided on heat resistant films, so that circuit components having desired electrical properties can be immediately mass-produced in response to orders. The electrical properties of the film electrical elements can be recognized when the same are provided on heat resistant films, whereby various products can be immediately produced in small quantities by previously preparing various types of film electrical elements, electrical properties of which are different from each other.

It is easy to form a film electrical element of uniform thickness on a heat resistant film. If the surface of the heat resistant film is smooth and flat, the surface of the film electrical element, which is provided upon separation of the heat resistant film, is also smooth and flat. Thus, the resistance value can be changed in correctly linear relation to the angle of rotation of the brush by manufacturing the stator for a variable resistor through the method of the present invention. Further, the circuit components are prevented from dispersion in electrical property of the film electrical elements.

The film electrical element can be embedded in the substrate so that its surface is even level with that of the substrate, to improve adhesion of the film electrical element to the substrate.

Further, the heat resistant film can be made flexible to allow formation of the film electrical element on a curved surface.

The substrate can be obtained by forming through resin, to have a complicated configuration.

According to a preferred embodiment of the present invention, provided are materials for a substrate and a resistor film for manufacturing a stator for a variable resistor at a low cost. The substrate is formed of allyle resin while the resistor film contains carbon powder and allyle resin serving as binder resin. The allyle resin, such as diallyl phthalate resin, is adapted to improve heat resistance, thereby to obtain a resistor film which is less deteriorated at the melting temperature of solder.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
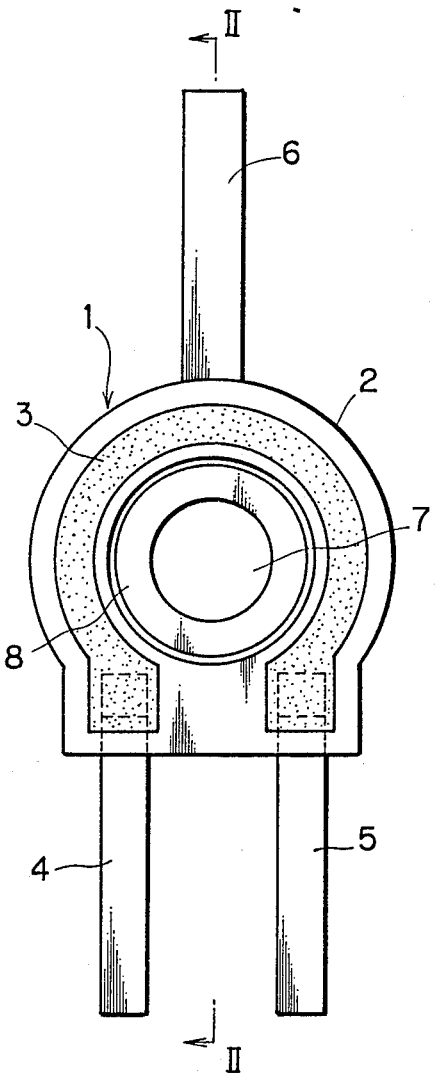
FIG. 1 is a plan view showing a stator for a variable resistor, which is obtained by carrying out a method according to invention.
Figure 2:
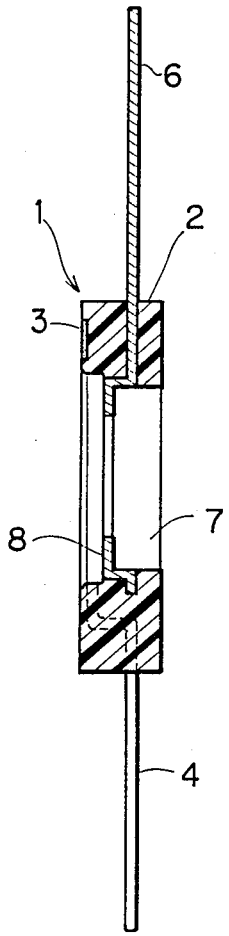
FIG. 2 is a view taken along the line II—II in FIG. 1.

Referring to FIGS. 1 and 2, a stator 1 for a variable resistor comprises a substrate 2 of resin and a substantially C-shaped resistor film 3 provided on the surface of the substrate 2. The resistor film 3 is so embedded in the substrate as to define a surface which is substantially flush with that of the substrate 2. Further, parts of lead terminals 4, 5 and 6 are buried in the substrate 2. Within the lead terminals 4, 5 and 6, the lead terminal 4 is electrically connected to an end of the resistor film 3 and the lead terminal 5 is electrically connected to the other end of the resistor film 3. A hole 7 is provided in a substantially central portion of the substrate 2. The lead terminal 6 is integrally provided with an annular collector 8, which inwardly extends from the inner peripheral surface of the hole 7.

Figure 3:
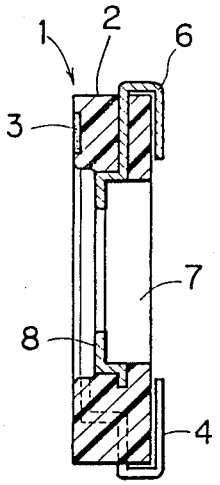
FIG. 3 is sectional view corresponding to FIG. 2, showing lead terminals being in bent states.

Portions of the lead terminals 4, 5 and 6 outwardly extending from the substrate 2 may be respectively cut in appropriate lengths, to be bent along one surface of the substrate 2, as shown in FIG. 3. The stator 1 having the structure as shown in FIG. 1 is adapted to form a variable resistor, which can be face-bonded to a printed circuit board or the like.

Figure 4:
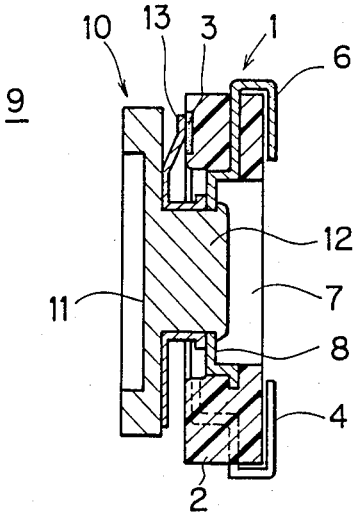
FIG. 4 is a sectional view showing a variable resistor completed by employing the stator as shown in FIG. 3.

FIG. 4 is a sectional view showing a variable resistor 9 which is obtained through the stator 1 as shown in FIG. 3. In addition to the stator 1, the variable resistor 9 includes a rotor 10, which comprises a rotary shaft 12 provided with an adjusting groove 11 and a brush 13. The brush 13 rotates with the rotary shaft 12, to slide along the surface of the resistor film 3. This brush 13 is electrically connected to the lead terminal 6 of the stator 1.

Description is now made on a method of manufacturing the stator 1.

Figure 7:
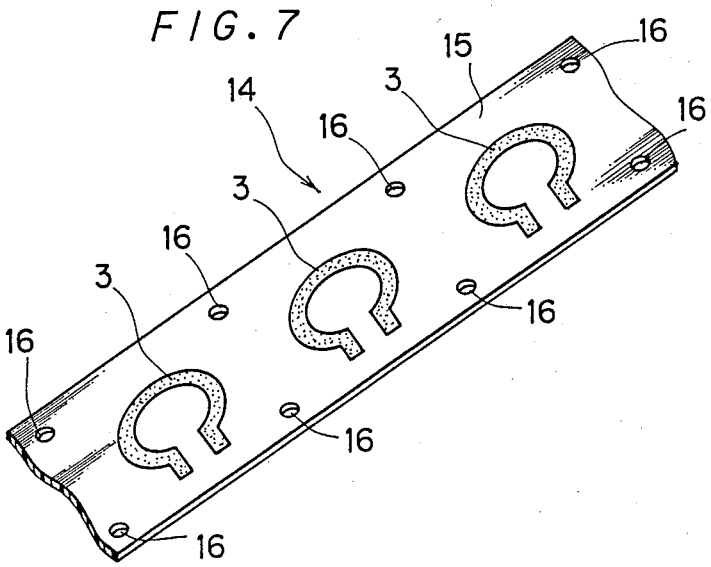
FIG. 7 is a perspective view showing a part of the transfer sheet.
Figure 5:
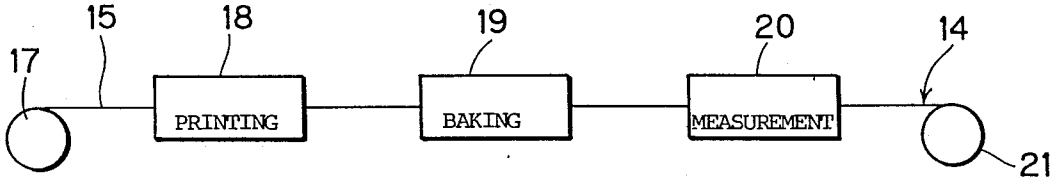
FIG. 5 illustrates the process of manufacturing a transfer sheet.

FIG. 7 shows a transfer sheet 14, which is obtained through the process as shown in FIG. 5. This transfer sheet 14 comprises a strip-shaped heat resistant film 15. Perforations 16 are provided at regular intervals on both side edges of the heat resistant film 15. The perforations 16 are adapted to reliably feed the heat resistant film 15 at regular intervals, as well as to locate the same in forming dies as hereinafter described. Resistor films 3 are provided on the surface of the heat resistant film 15. The resistor films 3, configurations of which are reverse to that shown in FIG. 1, are distributed at regular intervals along the longitudinal direction of the heat resistant film 15. The heat resistant film 15 is preferably formed of imide resin such as polyimide, which is excellent in heat resistance and dimensional stability. Alternatively, the heat resistant film 15 may be formed of a composite structure, which is prepared by stainless steel or aluminum foil coated with imide resin, for example.

Referring to FIG. 5, the heat resistant film 15 is prepared in a state wound on a reel 17, and delivered from the reel 17 to be taken up by another reel 21 sequentially through a printing station 18, a baking station 19 and a resistance value measuring station 20.

First, resistive paste films corresponding to the resistor films 3 in configuration are provided on the heat resistant film 15 by screen printing in the printing station 18. The paste films are naturally dried or forcibly dried at a temperature of 150° C. for about five minutes, for example.

Then, the heat resistant film 15 is introduced into an electric furnace in the baking station 19, so that the paste films are baked to the heat resistant film 15. This baking step is performed at a temperature of 260° C. for about 15 minutes, for example. Upon completion of such baking, the resistor films 3 are provided by the paste films.

Then, checked in the resistance value measuring station 20 is whether or not resistance property of the resistor films 3 is within a desirable range. This is to confirm whether or not composition of the resistive paste employed to obtain the resistor films 3 and conditions of printing, drying and baking are adequate. Properties of the resistor films 3 are checked with respect to parts or all of the resistor films 3 provided on the heat resistant film 15. The heat resistant film 15 provided with the resistor films 3, properties of which are within a desired range, is taken up by the reel 21, to define the transfer sheet 14. Various types of such transfer sheets 14 are thus taken up by various reels 21 in response to the types of variable resistors to be obtained, thereby to immediately cope with replacement of variable resistors.

Figure 6:
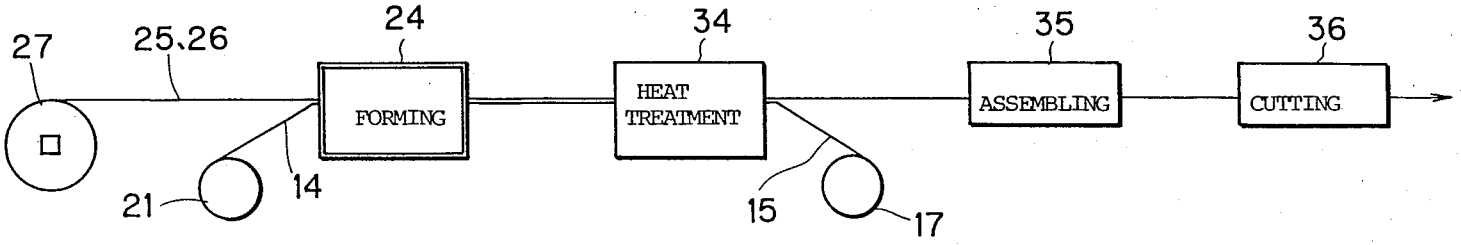
FIG. 6 illustrates the process of manufacturing a stator by employing the transfer sheet obtained through the process in FIG. 5.
Figure 8:
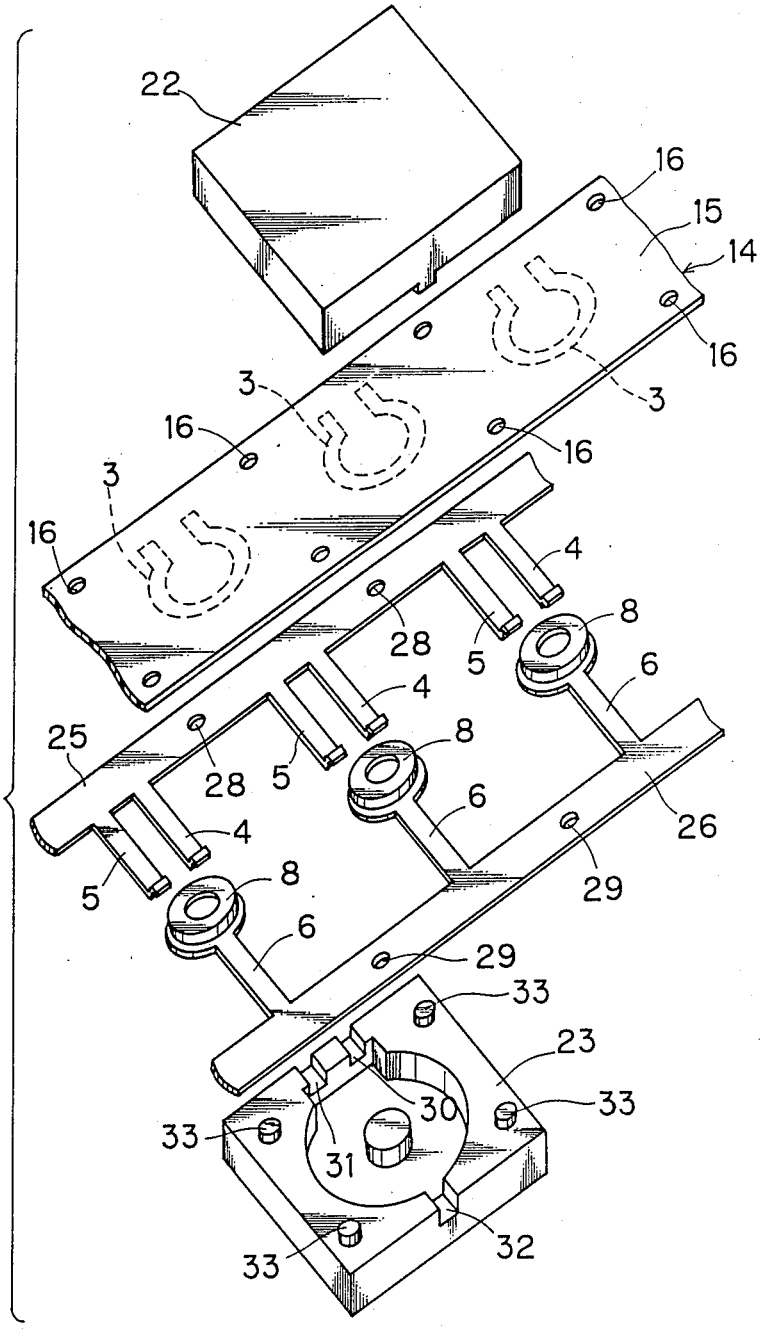
FIG. 8 is an exploded perspective view showing a step of forming a substrate included in the stator.
Figure 9:
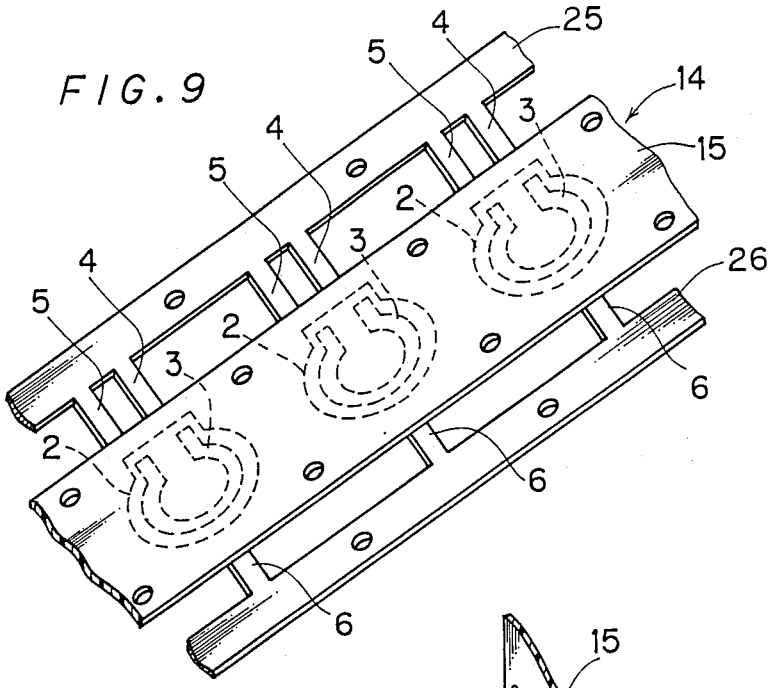
FIG. 9 is a perspective view showing a state after forming of the substrate.

Then, as shown In FIGS. 6 and 8, the transfer sheet 14 delivered from the reel 21 and the lead terminals 4, 5 and 6 are received/located in cavities defined by forming dies 22 and 23, to perform a step of forming the substrates 2. This step is carried out in a forming station 24 as shown in FIG. 6. The lead terminals 4 and 5 are provided as parts of a hoop 25, while the lead terminals 6 are provided as parts of another hoop 26. The hoops 25 and 26 are wound on a reel 27. The hoops 25 and 26 are respectively provided with perforations 28 and 29, which are adapted to feed the hoops 25 and 26 at regular intervals, thereby to introduce the same into the cavities defined by the forming dies 22 and 23. The lead terminals 4, 5 and 6 are engaged in grooves 30, 31 and 32 provided in the forming die 23. On the other hand, the perforations 16 provided in the heat resistant film 15 receive projections 33 provided on the forming die 23, to locate the transfer sheet 14 on the forming die 23.

Upon such location of the transfer sheet 14 and the lead terminals 4, 5 and 6 in the forming die 23, the forming dies 22 and 23 are brought into contact with each other, to close the cavities defined by the same. Then, thermosetting resin such as diallyl phthalate resin is introduced into the cavities. Such diallyl phthalate resin is prepared in the form of powder or a tablet, which is softened or molten at a temperature of 80° to 100° C., to be introduced into the cavities defined by the forming dies 22 and 23 in this molten state. Then the resin is heated to a temperature of 160° to 180° C., to be hardened in the cavities. Alternatively, the powder or tablet of resin may be directly introduced into the cavities and thereafter increased in temperature to be molten and hardened in the cavities.

The resin is thus hardened to form the substrate 2, each of which is internally provided with the buried lead terminals 4, 5 and 6 and having the resistor film 3 and the heat resistant film 15 fixed to its surface.

Thus, the substrates 2 are successively formed by the forming dies 22 and 23 and discharged from the same in a series defined by the hoops 25 and 26 and the heat resistant film 15.

If necessary, the substrates 2 are subjected to heat treatment for breathing or the like, in a heat treatment station 34 as shown in FIG. 6.

Figure 10:
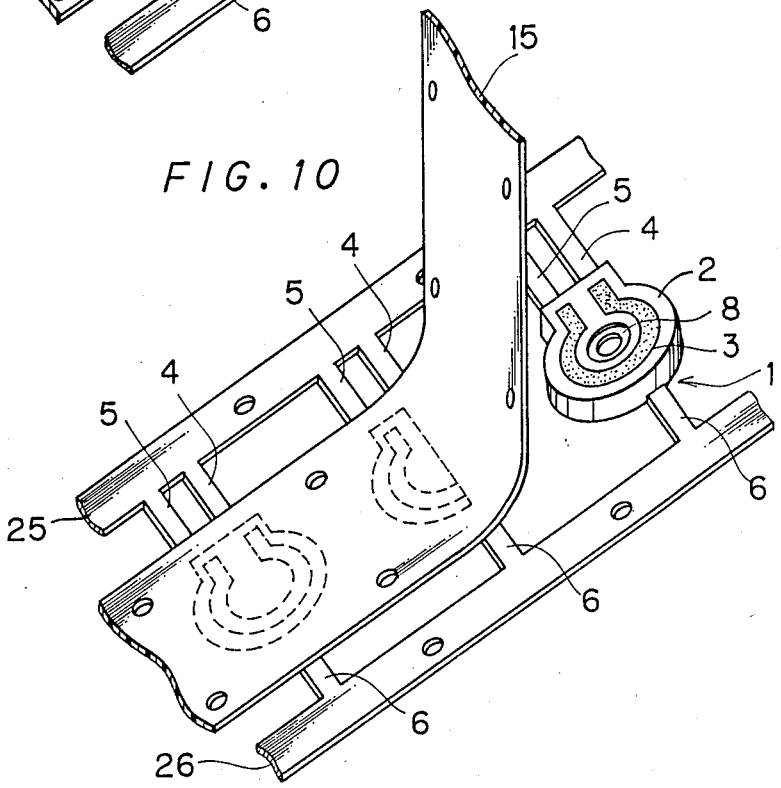
FIG. 10 is a perspective view showing a step of separating a heat resistant film from the substrate.

Then, the heat resistant film 15 is separated from the substrates 2 as shown in FIG. 10. At this time, the resistor films 3 provided on the surface of the heat resistant film 15 are not separated from the substrates 2 since the same are embedded in the substrates 2 to be flush with the surfaces thereof. The resistor films 3 maintain the properties measured in the state being held by the heat resistant film 15.

The heat resistant film 15 thus separated from the substrates 2 is again taken up by the reel 17, to be reusable.

Each substrate 2 separated from the heat resistant film 15 is fed to an assembling station 35, to be assembled with the rotor 10 as shown in FIG. 4.

Then, the lead terminals 4, 5 and 6 are cut from the hoops 25 and 26 in a cutting station 36, to provide the variable resistor 9 as a finished product. The lead terminals 4, 5 and 6 may be bent in order to obtain the variable resistor 9 as shown in FIG. 4.

Consideration is now made on preferable materials for the resistor film 3 and the substrate 2, with reference to Table 1.

In order to obtain resistor films, 8.0 to 70.0 percent by weight of carbon powder, such as carbon black or graphite, as a main component, 0 to 40.0 percent by weight of an inorganic filler for serving as a resistance conditioner and 30.0 to 70.0 percent by weight of binder resin, to which 1.0 to 5.0 percent by weight of a thermohardening agent prepared by an organic peroxide such as tertiary butyl peroxibenzoate, di-cumyl peroxide or benzoyl peroxide and an appropriate amount of a solvent of ethyl carbitol acetate were added, were mixed to provide paste. The binder resin was prepared by diallyl phthalate resin in each of Examples 1 and 2 and reference examples 1, 3 and 4, and by phenol resin in reference example 2, as shown in Table 1.

TABLE 1

| | | Example 1 | Example 2 | Reference Example 1 | Reference Example 2 | Reference Example 3 | Reference Example 4 |
|---|---|---|---|---|---|---|---|
| Binder Resin in Resistive Paste | | diallyl phthalate | diallyl phthalate | diallyl phthalate | phenol | diallyl phthalate | diallyl phthalate |
| Main Component of Substrate | | diallyl phthalate | diallyl phthalate | alumina | diallyl phthalate | polyphenylene sulfide | glass/epoxy |
| Resistance | | 260Ω | 200kΩ | 200kΩ | 200kΩ | 200kΩ | 200kΩ |
| TCR −40° C./+125° C. | | −204/+210 | −111/+170 | −240/+433 | −260/+108 | −343/+281 | −421/+311 |
| Rate of Change in Resistance by Dipping in Solder | 230° C. | −0.86% | +0.96% | +8.65% | +5.23% | +13.16% | +14.65% |
| | 270° C. | −1.5% | +2.05% | +23.01% | bubbled | substrate deformed | substrate discolored |

In each of Examples 1 and 2 and reference example 2, resin for forming the substrate was prepared by mixing 40 percent by weight of diallyl phthalate resin as a main component, 30 percent by weight of an inorganic filler, 30 percent by weight of glass staple and a thermohardening agent, being similar to the above, of 1 to 5 percent by weight with respect to diallyl phthalate resin, hot kneading and pulverizing the same. In reference example 3, polyphenylene sulfide was employed in place of diallyl phthalate resin. Further, an alumina substrate was employed in reference example 1 and a glass/epoxy substrate was employed in reference example.

It is understood from Table 1 that Examples 1 and 2 are smaller in resistance-temperature coefficient (TCR) than reference examples 1 to 4, as well as in rate of change in resistance caused by dipping in solder. In particular, the substrate of reference example 2 was bubbled and that of reference example 3 was deformed while the substrate of reference example 4 was discolored when dipped in solder. In Examples 1 and 2, on the other hand, substantially no change was caused in resistance upon ultrasonic cleaning employing 1, 1, 1-trichloroethane.

Although the embodiment of the present invention has been described in detail in relation to a stator employed for a variable resistor, the variable resistor to which the present invention is applied is not restricted to that shown in FIGS. 1 to 4. For example, the variable resistor may be in the form of a cylinder provided with a resistor film on its inner surface. Further, the present invention can be applied to a variable resistor having lead terminals which are not buried in a substrate but fixed to the same by caulking or the like.

Further, a resistive paste film may be provided on a heat resistant film and baked so that metal paste of a good conductor is overlappingly printed on portions to be connected with lead terminals and baked to provide conductor films, thereby to further reliably facilitate electrical connection between a resistor film and the lead terminals by the conductor films.

The present invention is not restricted to the stator for a variable resistor, but is applicable to other circuit elements as hereinafter described.

Figure 11:
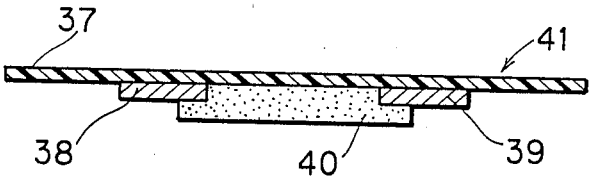
FIGS. 11 to 13 are sectional views sequentially showing steps in included in another embodiment of the present invention.
Figure 12:
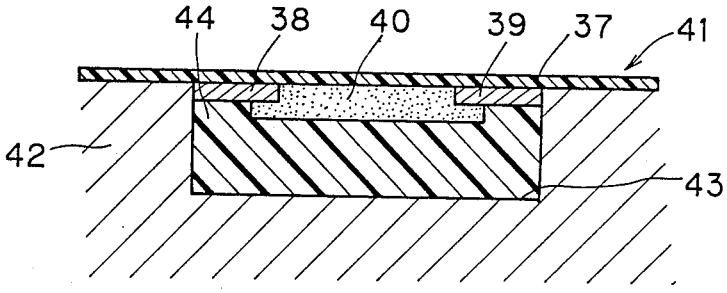
Figure 13:
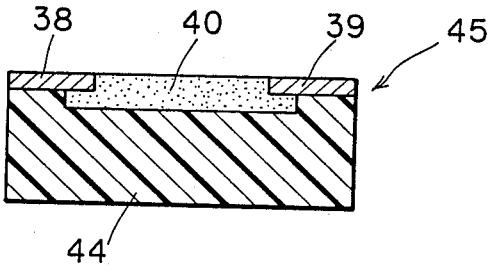

FIGS. 11 to 13 are adapted to illustrate a method of manufacturing a chip resistor according to the present invention.

Referring to FIG. 11, two conductor films 38 and 39 are formed on one surface of a heat resistant film 37 at a space. Then, a resistor film 40 is provided to connect the conductor films 38 and 39 with each other.

A transfer sheet 41 thus obtained is located in a forming die 42, as shown in FIG. 12. At this time, the conductor films 38 and 39 and the resistor film 40 are exposed in a cavity 43 of the forming die 42. Then, resin is introduced into the cavity 43 to be hardened, thereby to form a substrate 44.

Then, the heat resistant film 37 is removed and the substrate 44 is taken out from the forming die 42, to obtain a desired chip resistor 45 as shown in FIG. 13.

Figure 14:
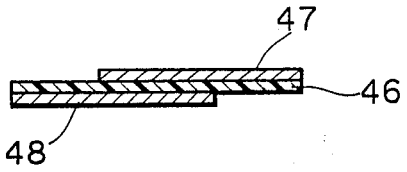
FIGS. 14 to 16 are sectional views sequentially showing steps included in still another embodiment of the present invention.
Figure 15:
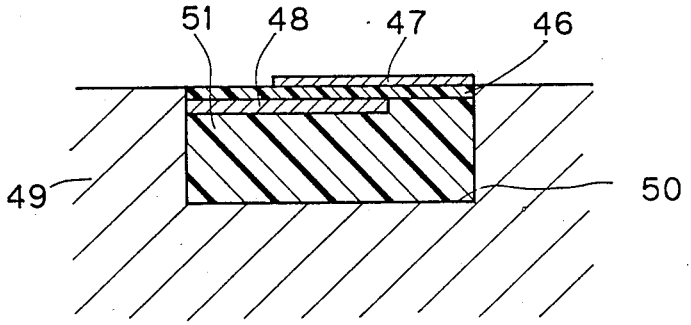
Figure 16:
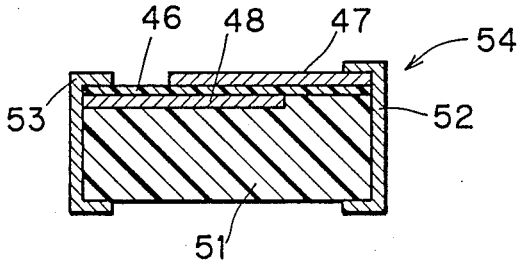

FIGS. 14 to 16 illustrate a method of obtaining a chip capacitor.

Referring to FIG. 14, conductor films 47 and 48 are provided on both surfaces of a heat resistant film 46, to partially overlap with each other.

Then, the heat resistant film 46 is located in a forming die 49 as shown in FIG. 15. Thereafter resin is introduced into a cavity 50 of the forming die 49, thereby to form a substrate 51.

Then, the substrate 51 is taken out from the forming die 49 as shown in FIG. 16, and external electrodes 52 and 53 are provided to be electrically connected to the conductor films 47 and 48 respectively. Thus, a desired chip capacitor 54 is obtained.

It is to be noted that the heat resistant film 46 in the embodiment as described with reference to FIGS. 14 to 16 is not removed but adapted to form a part of the circuit component. Namely, the heat resistant film 46 serves as a dielectric member in the chip capacitor 54.

In the step of separating the heat resistant film, the following treatment is preferably performed: First, the heat resistant film is chemically treated so that the film electrical element is easily separated from the heat resistant film. Second, the film electrical element provided on the heat resistant film is chemically treated to improve adhesion between the film electrical element and the substrate. In order to improve adhesion between a resistor film containing diallyl phthalate resin and a substrate of diallyl phthalate resin, for example, the resistor film is preferably treated by a silane coupling agent or silicon primer.

It is pointed out that the scope of the present invention is not limited by the aforementioned examples of the materials for the resistor film and the substrate.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing a circuit component comprising a substrate of resin and a film electrical element provided on the surface of said substrate, said method comprising:

a step of preparing a heat resistant film;

a step of providing a desired film electrical element on said heat resistant film;

a step of preparing a forming die having a cavity for forming a substrate;

a step of locating said heat resistant film provided with said film electrical element in said forming die to expose at least a part of said film electrical element in said cavity; and a step of introducing resin into said cavity to form by said resin a substrate joined with said at least a part of said film electrical element.

2. A method in accordance with claim 1, wherein said heat resistant film contains imide resin.

3. A method in accordance with claim 1, further comprising a step of separating said heat resistant film from said film electrical element joined with said substrate.

4. A method in accordance with claim 1, wherein said film electrical element includes a resistor film.

5. A method in accordance with claim 1, wherein said film electrical element includes a conductor film.

6. A method in accordance with claim 1, wherein said film electrical element includes a resistor film and a conductor film.

7. A method of manufacturing a stator, comprising a substrate of resin and a resistor film provided on the surface of said substrate, for a variable resistor, said method comprising:

a step of preparing a heat resistant film;

a step of preparing a transfer sheet by providing a resistor film on said heat resistant film;

a step of preparing a lead terminal for a variable resistor;

a step of preparing a forming die having a cavity for forming a substrate;

a step of locating said transfer sheet and said lead terminal in said forming die to expose at least a part of said resistor film in said cavity and position a part of said lead terminal in said cavity;

a step of introducing resin into said cavity to form by said resin a substrate joined with said at least a part of said resistor film, said part of said lead terminal being buried in said substrate; and a step of separating said heat resistant film from said substrate to leave said resistor film.

8. A method in accordance with claim 7, wherein said heat resistant film contains imide resin.

9. A method in accordance with claim 7, wherein said step of preparing said transfer sheet comprises a step of applying paste including a resistor to said heat resistant film to provide a paste film, a step of drying said paste film and a step of baking said paste film.

10. A method in accordance with claim 9, wherein said paste contains carbon powder and binder resin, said binder resin including allyle resin.

11. A method in accordance with claim 10, wherein said allyle resin comprises diallyl phthalate resin.

12. A method in accordance with claim 10, wherein said resin introduced into said cavity in said step of forming said substrate includes allyle resin.

13. A method in accordance with claim 12, wherein said allyle resin comprises diallyl phthalate resin.

* * * * *